US011248433B2

(12) United States Patent
Juhlin

(10) Patent No.: US 11,248,433 B2
(45) Date of Patent: Feb. 15, 2022

(54) INJECTING FLUID INTO A HYDROCARBON PRODUCTION LINE OR PROCESSING SYSTEM

(71) Applicant: Subsea 7 Norway AS, Stavanger (NO)

(72) Inventor: Rasmus Asp Juhlin, Stavanger (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 17/050,377

(22) PCT Filed: Apr. 24, 2019

(86) PCT No.: PCT/EP2019/060478

§ 371 (c)(1),
(2) Date: Oct. 23, 2020

(87) PCT Pub. No.: WO2019/206975

PCT Pub. Date: Oct. 31, 2019

(65) Prior Publication Data

US 2021/0087901 A1 Mar. 25, 2021

(30) Foreign Application Priority Data

Apr. 24, 2018 (GB) ..... 1806667

(51) Int. Cl.
*E21B 33/076* (2006.01)
*E21B 34/04* (2006.01)

(52) U.S. Cl.
CPC ..... *E21B 33/076* (2013.01); *E21B 34/04* (2013.01)

(58) Field of Classification Search
CPC ..... E21B 33/076; E21B 34/04
See application file for complete search history.

(56) References Cited

U.S. PATENT DOCUMENTS 3,710,867 A * 1/1973 Bansbach ..... C09K 8/54 166/244.1
3,987,708 A * 10/1976 Uhrich ..... B63C 11/52 92/134
4,064,936 A * 12/1977 McClure ..... E21B 33/068 166/90.1
4,095,421 A * 6/1978 Silcox ..... E21B 33/0355 60/398
7,243,726 B2 * 7/2007 Ohmer ..... E21B 43/01 166/304

(Continued)

FOREIGN PATENT DOCUMENTS

EP 0 581 838 11/1992
EP 2 494 144 5/2011

(Continued)

*Primary Examiner* — Aaron L Lembo
(74) *Attorney, Agent, or Firm* — Levy & Grandinetti

(57) ABSTRACT

An injection fluid is pressurized for injection into a subsea installation or equipment by using a flow of hydrocarbon production fluid to draw the injection fluid from a source and using pressure of the production fluid to pressurize the drawn injection fluid to an elevated pressure. In response to an ejector that is powered by the flow of the production fluid, a pressure booster draws in the injection fluid for pressurization. A portion of the production fluid is diverted to the pressure booster to pressurize and expel the injection fluid and is then exhausted to the ejector as more injection fluid is drawn in.

36 Claims, 3 Drawing Sheets

(56) References Cited

U.S. PATENT DOCUMENTS

Figure 1:
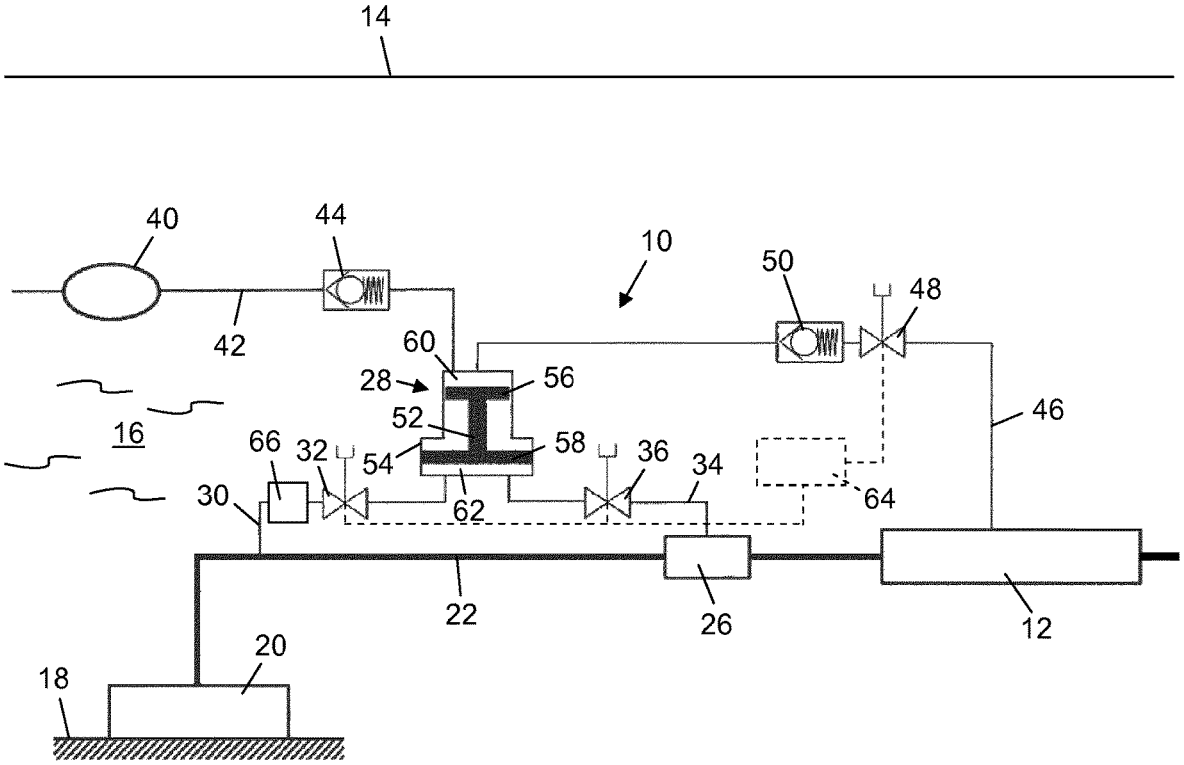

| | | | | |
|---|---|---|---|---|
| 7,530,392 | B2 * | 5/2009 | Sugiyama | E21B 43/08 166/263 |
| 7,870,899 | B2 * | 1/2011 | Wilson | E21B 41/02 166/244.1 |
| 7,934,433 | B1 * | 5/2011 | Franco | E21B 47/10 73/861.63 |
| 8,779,614 | B2 * | 7/2014 | Yarnold | E21B 41/0085 290/54 |
| 8,955,595 | B2 * | 2/2015 | Emecheta | E21B 33/0355 166/350 |
| 9,127,547 | B2 * | 9/2015 | Prukop | E21B 43/16 |
| 9,222,326 | B2 * | 12/2015 | Whitby | E21B 41/0085 |
| 9,303,479 | B2 * | 4/2016 | Kotrla | F15B 1/24 |
| 9,835,019 | B2 * | 12/2017 | Saponja | E21B 43/34 |
| 10,442,711 | B2 * | 10/2019 | Mason | C02F 1/763 |
| 2003/0150619 | A1 * | 8/2003 | Meaders | E21B 34/16 166/360 |
| 2015/0006860 | A1 * | 1/2015 | Greiner | G06F 9/30185 712/223 |
| 2015/0218901 | A1 * | 8/2015 | Juhlin | E21B 43/128 166/105.1 |
| 2015/0285036 | A1 * | 10/2015 | Theron | E21B 41/02 166/338 |

FOREIGN PATENT DOCUMENTS

| | | |
|---|---|---|
| FR | 2 738 872 | 3/1997 |
| WO | WO 01/16459 | 3/2001 |
| WO | WO 2004/016904 | 2/2004 |
| WO | WO 2016/154228 | 9/2016 |
| WO | WO 2017/023582 | 2/2017 |
| WO | WO 2018/064115 | 4/2018 |
| WO | WO 2018/071193 | 4/2018 |

* cited by examiner

INJECTING FLUID INTO A HYDROCARBON PRODUCTION LINE OR PROCESSING SYSTEM

This invention relates to the injection of fluid into a production line used to convey hydrocarbons in the oil and gas industry or into a system for processing production fluids. The invention is particularly concerned with the challenge of providing boosting pressure for injecting fluid into a subsea production line or processing system without necessarily using an externally-powered pump.

Chemicals may have to be injected into oil or gas production lines or processing systems from time to time for the purposes of maintenance and flow assurance. For example, chemicals may be injected to remove or to mitigate the formation of wax, asphaltenes or hydrates in hydrocarbon production fluid within a pipeline, or simply in preparation for shut-down. Such chemicals may therefore be characterised as flushing, remediation or preservation fluids.

To enable their injection into a production line, it is necessary to pressurise chemicals to above the pressure of the production fluid that flows from a wellhead and along the production line.

In general, ancillary systems that are straightforward to implement in a topside production facility are more complicated to implement in a subsea production or processing facility. For example, a system for flushing sensors is relatively simple to install in a topside facility where power and control lines are easily available. Similarly, maintenance and inspection of a topside facility is relatively simple because there is ready access for personnel. In contrast, in a subsea facility, power and control has to be delivered through an umbilical. Inspection and maintenance is also much more complicated. This applies especially in a facility used to exploit a small field, where there may be a long tie-back connection to a remote subsea well.

A conventional injection method used in the subsea oil and gas industry involves the use of a resident, retrievable chemical tank that is placed beside a production line on the seabed. The tank is fitted with a pump and connected to an umbilical hanging from the surface. The umbilical conveys the additional power required to elevate the pressure of the fluid for injection into the production line.

The two main ways of supplying remotely-generated power to subsea systems are to supply electricity via either a cable or an umbilical, or to supply hydraulic power via an umbilical. The more power that is needed, the bigger the cable or umbilical needs to be; and hence the more expensive the cable or umbilical is to make and to install.

A common approach to obviate umbilicals or at least to reduce their size and cost is to generate power at a subsea location close to where that power is needed. Various solutions are known for producing electric power locally underwater, examples being current turbines, thermoelectricity, batteries and fuel cells.

Where the purpose of generating electric power is to pressurise a fluid, that power is used to drive a pump. For example, U.S. Pat. No. 8,955,595 discloses using subsea pumps to pressurise a fluid that is used to fill pressure accumulators and is then delivered. This presents a problem, particularly subsea, because a pump may be unreliable and replacing it will be costly. Additional rotary or rotating equipment should be avoided in subsea applications where possible.

FR 2738872 teaches using the heat of crude oil flowing from a well in a Rankin cycle employing a turbo-alternator to produce electric power. Re-using heat energy to power an electric pump is inefficient.

For these and other reasons, hydraulic pressure boosting is preferred. One well-known approach to this is to use hydrostatic pressure resulting from the weight of the water column above the equipment to be powered. Typical prior art in this respect comprises arrangements of bladders and/or pistons. For example, U.S. Pat. No. 4,095,421 discloses a piston. EP 0581838 discloses an accumulator system that uses hydrostatic pressure to power a tool. U.S. Pat. No. 3,987,708 teaches using a pressure differential to regulate pressure in an underwater hydraulic circuit.

The most common application for subsea pressure amplifiers is to actuate rams in blow-out preventers or BOPs, which have to be capable of shutting down a well in a few seconds to prevent an accidental discharge of hydrocarbons into the environment. An example is the piston arrangement of U.S. Pat. No. 9,303,479. U.S. Pat. No. 9,222,326 discloses a typical pressure intensifier, also based on a piston arrangement, which uses accumulators to store pressurised fluids.

A common drawback of the above hydraulic systems is that contact with seawater may corrode a piston mechanism. Also, such systems can only be useful for injection where the pressure of production fluid flowing from the well is lower than the prevailing hydrostatic pressure. As this is not always the case, a pressure boost will often be needed.

In U.S. Pat. No. 8,779,614, a flow of pressurised fluid from the surface drives a subsea turbine or a fluid-operated motor to power a wellhead. Disadvantageously, this requires rotary equipment to be positioned subsea and also requires an umbilical from the surface to convey hydraulic power.

EP 2494144 discloses recovering high pressure from production fluid flowing from a subsea well to power a volumetric pump that is used as a booster. However, the pump presents reliability concerns as noted above.

WO 2016/154228 teaches using the pressure of a produced flow to power a rotary or reciprocating pump that pressurises a second fluid, namely water, for injection into a low-pressure well. However, this does not teach boosting the pressure of the second fluid to above the pressure of the produced flow.

WO 01/16459 describes an apparatus for injecting treatment chemicals into an oil producing well. The apparatus uses a venturi nozzle to introduce the chemicals into the well. WO 2018/064115 describes an alternative method of pressurising an injection fluid for injection into an installation or equipment subsea.

Furthermore, U.S. Pat. Nos. 3,710,867, 4,064,936 and WO 2004/016904 describe various methods of introducing chemicals into an oil well. US 2015/285036 describes a system for injecting small amounts of fluid, such as a de-emulsifier at high pressure.

Against this background, the invention provides a method of pressurising an injection fluid for injection into an installation or equipment subsea. The method comprises: using a flow of hydrocarbon production fluid to draw the injection fluid from a source, in which the injection fluid may be under hydrostatic pressure; and using pressure of the production fluid to pressurise the drawn injection fluid to an elevated pressure that may be above the pressure of the production fluid.

Conveniently, the flow may be in a subsea production pipeline that extends from a subsea wellhead. Gas may be separated and removed from the production fluid before using the production fluid to pressurise the injection fluid.

The injection fluid may be drawn and pressurised in alternating cycles. Preferably the injection fluid is drawn from the source through a non-return valve.

Advantageously, the injection fluid may be drawn from the source by using the flow of production fluid to generate a reduced pressure relative to pressure of the injection fluid in the source. For example, the flow of production fluid may be used to drive a pump that generates the reduced pressure.

The injection fluid may be drawn into an injection fluid chamber by reducing pressure in the injection fluid chamber, for example to a level below hydrostatic pressure outside the injection fluid chamber. The injection fluid can then be pressurised in the injection fluid chamber.

Production fluid may pass through an open pressurisation control valve when pressurising the injection fluid in the injection fluid chamber. The pressurisation control valve can then be closed when drawing the injection fluid into the injection fluid chamber. The pressurisation control valve may be controlled to control pressurisation of the injection fluid in the injection fluid chamber.

A portion of the flow of production fluid may be diverted to pressurise the injection fluid in the injection fluid chamber. The diverted portion of the production fluid may be introduced into a production fluid chamber to pressurise the injection fluid in the injection fluid chamber. In that case, the production fluid chamber may be expanded under pressure from the introduced portion of the production fluid, causing the injection fluid chamber to contract in response. For example, a piston may be reciprocated between the production fluid chamber and the injection fluid chamber, that piston having opposed heads that partially define the respective chambers.

A reduced pressure may be generated in the production fluid chamber to reduce pressure in the injection fluid chamber. This may be done to contract the production fluid chamber and to expand the injection fluid chamber in response.

Production fluid drawn from the contracting production fluid chamber may be returned to the flow of production fluid. The returned production fluid may be passed through a filling control valve when drawing the injection fluid into the expanding injection fluid chamber. The filling control valve may be controlled to control filling of the injection fluid chamber with the injection fluid.

The method of the invention may further comprise injecting the pressurised injection fluid into the subsea installation or equipment. For example, the pressurised injection fluid may be passed through an injection control valve and/or a non-return valve before injection into the subsea installation or equipment. The injection control valve may be controlled to control injection of the injection fluid into the subsea installation or equipment.

The inventive concept embraces a system for pressurising an injection fluid for injection into an installation or equipment subsea and thus for performing the method of the invention. The system comprises: an injection fluid source containing the injection fluid; a production fluid source containing a hydrocarbon production fluid; an ejector that is powered by a flow of the production fluid; and a pressure booster that is responsive to the ejector to draw injection fluid from the injection fluid source for pressurisation.

The pressure booster comprises: an injection fluid inlet connected to the injection fluid source; a production fluid inlet connected to the production fluid source to receive production fluid under pressure to pressurise the injection fluid advantageously to above the pressure of the production fluid; a production fluid outlet connected to the ejector to exhaust the production fluid; and an injection fluid outlet for the pressurised injection fluid. Preferably, a subsea production pipeline serves as the production fluid source and channels the flow of the production fluid.

The pressure booster may further comprise: a production fluid chamber communicating with the production fluid inlet for receiving the production fluid from the production fluid source and communicating with the production fluid outlet for exhausting the production fluid, the production fluid chamber being expansible in response to receiving the production fluid; and an injection fluid chamber for pressurising the injection fluid by contracting in response to expansion of the production fluid chamber, the injection fluid chamber communicating with the injection fluid inlet for receiving the injection fluid from the injection fluid source and communicating with the injection fluid outlet for outputting the pressurised injection fluid.

Where the pressure booster further comprises a piston between the production fluid chamber and the injection fluid chamber, that piston having opposed piston heads that partially define the respective chambers, the piston head of the production fluid chamber suitably has a greater diameter than the piston head of the injection fluid chamber.

A production fluid diversion line suitably connects the pressure booster to the production fluid source. There may be a gas separator in the production fluid diversion line. A pressurisation control valve in the production fluid diversion line may control expansion of the production fluid chamber and contraction of the injection fluid chamber.

A return line suitably connects the pressure booster to the ejector. A filling control valve in the return line may control contraction of the production fluid chamber and expansion of the injection fluid chamber.

An injection line may be connected to the injection fluid outlet of the pressure booster. An injection control valve in the injection line may control injection of the injection fluid into the subsea installation or equipment. The injection line may further comprise a non-return valve.

The invention reduces the power consumption and control requirements of a subsea processing facility by using energy from production fluid flowing from a subsea well and by obviating the need for an additional pump. Pressure-boosting energy is thereby taken from the well instead of from a host system. The energy from the well is used to pressurise a fluid for injection, such as a flushing medium, to a sufficient pressure. The amount of energy required from the well is determined by the volume of fluid required for injection.

In view of its use deep underwater, equipment to implement the invention must be designed to cope with substantial external hydrostatic pressure. This may be achieved either by providing hollow parts of the equipment with sufficiently strong walls, or by maintaining sufficient internal pressure within thin-walled hollow parts to avoid their collapse. Beneficially, in preferred embodiments, the system of the invention is designed so that its lines contain either fluid at or above hydrostatic pressure, the fluid source typically being a pressure-compensated tank or bladder, or fluid close to wellhead outlet pressure, whose typical relative pressure is around 100 bars.

Embodiments of the invention provide a method for pressurising a fluid for injection into a remote subsea processing unit, the method comprising: using an ejector, such as a jet or suction pump, activated by the main production flow coming from a subsea well for aspiration of the fluid from a fluid source, such as a storage pressure vessel, into a pressure booster; and diverting a portion of production flow into the pressure booster for pressurising the fluid and injecting the pressurised fluid into the processing unit.

Pressure of the pressurised fluid at the exit of the pressure booster may be above the pressure of the main production flow.

Advantageously, the invention does not require the use of rotating equipment or a rotary machine.

The ejector is suitably controlled by a first flow from the pressure booster. The flow within the ejector control line may be controlled by a choke valve.

The pressure vessel may be a bladder. The pressure booster may comprise a piston within a chamber, in which case the piston of the pressure booster may have opposing heads of different areas.

The system may be controlled by opening or closing a first remotely-operated valve on an inlet for produced oil flow to the pressure booster, a second remotely-operated valve on an ejector input line, and a third remotely-operated valve on an injection line between the pressure booster and the injection point.

The remotely-operated valves may be actuated by an unmanned underwater vehicle (UUV) such as a remotely-operated vehicle (ROV). Alternatively, the remotely-operated valves may be actuated from another location such as a surface location, for example through a control umbilical or by using a signal that may be transmitted wirelessly.

In summary, an injection fluid is pressurised for injection into a subsea installation or equipment by using e hydrocarbon production fluid to draw the injection fluid from a source. Then, pressure of the production fluid is used to pressurise that injection fluid to an elevated pressure.

In response to an ejector that is powered by the flow of the production fluid, a pressure booster draws in the injection fluid for pressurisation. A portion of the production fluid is diverted to the pressure booster to pressurise and expel the injection fluid and is then exhausted to the ejector as more injection fluid is drawn in.

Figure 2:
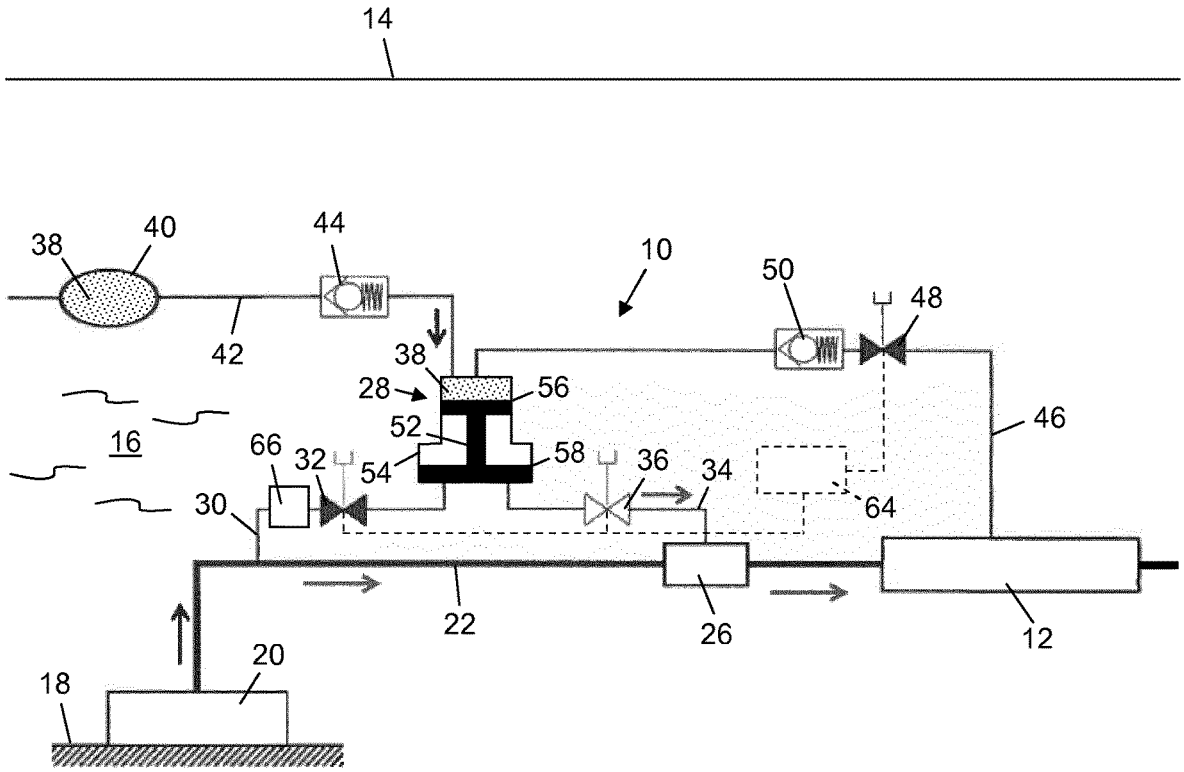
Figure 3:
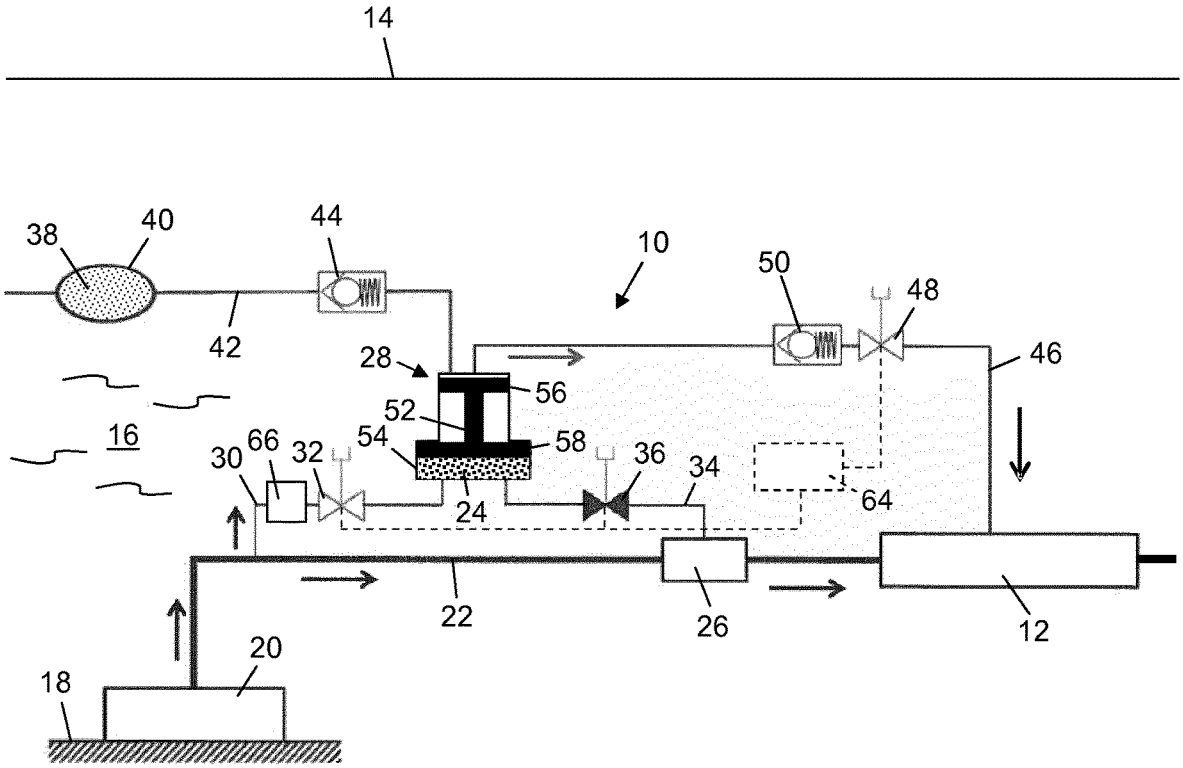

In order that the invention may be more readily understood, reference will now be made, by way of example, to the accompanying drawings in which:

FIG. 1 is a general layout diagram of a flushing system of the invention, powered by energy from a subsea well;

FIG. 2 corresponds to FIG. 1 but shows the system when it is filling a pressure booster with a flushing medium; and FIG. 3 corresponds to FIGS. 1 and 2 but shows the system when it is injecting the flushing medium into a subsea processing system.

The drawings exemplify a system 10 of the invention as a flushing system for injecting a fluid flushing medium into an output such as subsea processing unit 12. The system 10 is powered by energy from a subsea well.

The system 10 is beneath the surface 14 and so is submerged in, and surrounded by, seawater 16 that applies hydrostatic pressure to the components of the system 10.

On the seabed 18, the system 10 comprises a subsea wellhead 20, which commonly comprises a Christmas tree, and a production fluid conduit 22 such as a subsea pipeline for conveying hydrocarbon production fluid 24 from the wellhead 20 to the processing unit 12.

An ejector 26 is interposed in the production fluid conduit 22 between the wellhead 20 and the processing unit 12. The ejector 26, which may for example be a jet pump or suction pump, is powered by the flow of production fluid 24 along the production fluid conduit 22.

The system 10 further comprises a pressure booster 28, which may also be referred to as an amplifier or intensifier, that can receive production fluid 24 from the production fluid conduit 22 via a production fluid deviation line 30. The production fluid conduit 22 therefore serves as a production fluid source for the pressure booster 28. A first control valve 32 controls the flow of production fluid 24 along the production fluid deviation line 30 from the production fluid conduit 22 to the pressure booster 28.

The ejector 26 draws production fluid 24 from the pressure booster 28 and returns that production fluid 24 to the production fluid conduit 22 along a return line 34. A second control valve 36 controls the flow of production fluid 24 along the return line 34 from the pressure booster 28 to the production fluid conduit 22.

The pressure booster 28 also receives an injection fluid 38 such as a flushing medium, as shown in FIG. 2, from a subsea injection fluid source 40 such as a pressure-compensated reservoir or vessel or flexible bladder. The injection fluid 38 in the injection fluid source 40 is therefore at the hydrostatic pressure of the surrounding seawater 16. The injection fluid source 40 is fluidly connected to the pressure booster 28 by an injection fluid supply line 42. A non-return valve 44 ensures that the injection fluid can flow only one way in the injection fluid supply line 42 from the injection fluid source 40 to the pressure booster 28 rather than vice versa.

The pressure booster 28 elevates the pressure of the injection fluid 38 and outputs the thus-pressurised injection fluid 38 to the processing unit 12 via an injection line 46. A third control valve 48 controls the flow of injection fluid along the injection line 46 from the pressure booster 28 to the processing unit 12. A non-return valve 50 ensures that the injection fluid can flow only one way in the injection line 46 from the pressure booster 28 to the processing unit 12 rather than vice versa.

The pressure booster 28 may take various forms. The example shown here comprises an asymmetric piston 52 that reciprocates in a complementary casing 54. The piston 52 is shown in an intermediate position within the casing 54 in FIG. 1.

The piston 52 has opposed heads 56, 58. The heads 56, 58 are of different diameters and hence areas. The casing 54 has complementary bores whose diameters correspond to the respective pistons 56, 58.

The smaller head 56 of the piston 52 cooperates with its corresponding bore of the casing 54 to define an injection fluid chamber 60, as shown in FIG. 1. The injection fluid chamber 60 communicates with the injection fluid source 40 via the injection fluid supply line 42 to receive injection fluid 38, as shown in FIG. 2.

The larger head 58 of the piston 52 cooperates with its corresponding bore of the casing 54 to define a production fluid chamber 62, as shown in FIG. 1. The production fluid chamber 62 communicates with the wellhead 20 via the production fluid deviation line 30 to receive production fluid 24 as shown in FIG. 3.

The state of one or more of the control valves 32, 36, 48 may be controlled by a controller 64 as shown. The controller 64 may be a part of the system 10 or may be remote from the system 10. The controller 64 may receive control signals via wired or wireless connections or may communicate control signals to the control valves 32, 36, 48 via such connections.

Control of the control valves 32, 36, 48 may also be effected by a UUV such as an ROV, which may couple torque tools to the control valves 32, 36, 48 to turn associated control elements. A UUV may be used for primary or auxiliary control of the control valves 32, 36, 48.

The drawings also show an optional gas separator 66, such as a gas harp, in the production fluid deviation line 30 between the production fluid conduit 22 and the pressure booster 28. As oil is a multiphase fluid, separation and removal of gas from the production fluid 24 before the pressure booster 28 ensures consistent pressure. Separation and removal of gas from the production fluid 24 may also ensure effective pumping by the ejector 26.

The operation of the system 10 will now be described with reference to FIGS. 2 and 3. Those drawings observe the convention that the control valves 32, 36, 48 are shown in white when open and in black when closed.

FIG. 2 shows the system 10 when it is filling or charging the injection fluid chamber 60 of the pressure booster 28 with the injection fluid 38 drawn from the injection fluid source 40. To achieve this, the second control valve 36 is opened so that the ejector 26 reduces the pressure in the production fluid chamber 62 of the pressure booster 28.

Reducing the pressure in the production fluid chamber 62 moves the piston 52 to contract the production fluid chamber 62 and to expand, and hence reduce the pressure in, the injection fluid chamber 60 on the opposite side of the piston 52. The resulting overpressure in the injection fluid 38 held at hydrostatic pressure in the injection fluid source 40 forces the injection fluid 38 along the injection fluid supply line 42 and into the injection fluid chamber 60.

In the filling stage shown in FIG. 2, the first control valve 32 is closed to prevent production fluid 24 reaching the pressure booster 28 along the production fluid deviation line 30. The third control valve 48 is also closed to prevent injection fluid 38 passing along the injection line 46 into the processing unit 12. Conversely, it will be apparent that the open second control valve 32 may serve as a filling or charging control valve for controlling how the injection fluid 38 is drawn into the injection fluid chamber 60.

FIG. 3 shows the system 10 in an injection stage when it is injecting the injection fluid 38 into the processing unit 12. Now, the second control valve 36 is closed and the first control valve 32 is open. In consequence, production fluid 24 flows along the production fluid deviation line 30 from the production fluid conduit 22 into the production fluid chamber 62 of the pressure booster 28. This increases the pressure in, and hence expands, the production fluid chamber 62 and moves the piston 52 to contract, and hence increase the pressure in, the injection fluid chamber 60 on the opposite side of the piston 52.

It will be apparent that the first control valve 32 may serve as a pressurisation control valve for controlling how the injection fluid 38 is pressurised in the injection fluid chamber 60.

By virtue of the asymmetry of the piston 52, the pressure in the injection fluid chamber 60 is boosted to exceed the pressure of the production fluid 24 in the production fluid chamber 62. Thus, the pressure of the injection fluid 38 in the injection fluid chamber 60 is increased to above the pressure of the production fluid 24 in the production fluid conduit 22 and hence in the processing unit 12.

When it is desired to inject the thus-pressurised injection fluid 38 into the processing unit 12, the third control valve 48 is opened to allow the injection fluid 38 to flow from the pressure booster 28 and into the processing unit 12 along the injection line 46. The third control valve 48 may be a choke valve that serves as an injection control valve, being adjustable to adjust the flow and pressure of the injection fluid 38 flowing along the injection line 46.

When the injection fluid chamber 60 has emptied, a filling or charging cycle can begin again by closing the first and third control valves 32, 48 and opening the second control valve 36. This allows the ejector 26 to draw the production fluid 24 from the production fluid chamber 62 of the pressure booster 28 and to exhaust that production fluid 24 back into the production fluid conduit 22.

Many variations are possible within the inventive concept. For example, it should be understood that other fluids such as remediation or preservation liquids, or other chemicals, may be injected in accordance with the invention.

The invention also contemplates that fluids may be injected into, or otherwise outputted to, subsea equipment or installations other than a processing unit, such as a subsea pipeline or into interim storage equipment. For example, once the pressure of a fluid has been elevated in accordance with the invention, fluids may be injected at that elevated pressure into an accumulator or other storage equipment and held at that pressure for subsequent injection into a subsea installation or other subsea equipment.

Alternatives to a piston-based pressure booster are possible, such as a hydraulically-powered pump. For example, a pump may comprise a turbine disposed in the flow of production fluid, a compressor driven by the turbine, conveniently on the same shaft, and a gear system for boosting.

If the system of the invention is used with sour production fluids containing a high level of hydrogen sulphide (H2S), there is a risk of corrosion of components such as piston heads and seals. Consequently, for ease of maintenance and refilling, parts of the system such as the pressure booster and/or the injection fluid source may be mounted on an ROV or a recoverable skid. Parts of the system may also be implemented in a retrievable module, which may comprise a standardised transport and installation frame like those proposed for some subsea processing systems.

The invention claimed is:

1. A method of pressurising an injection fluid for injection into an installation or equipment subsea, the method comprising:

using a flow of hydrocarbon production fluid to generate a reduced pressure relative to pressure of the injection fluid in a source so as to draw the injection fluid from the source; and using pressure of the production fluid to pressurise the drawn injection fluid to an elevated pressure above the pressure of the production fluid.

2. The method of claim 1, wherein the injection fluid is under hydrostatic pressure at the source.

3. The method of claim 1, comprising drawing and pressurising the injection fluid in alternating cycles.

4. The method of claim 1, comprising drawing the injection fluid from the source through a non-return valve.

5. The method of claim 1, comprising using the flow of production fluid to drive a pump that generates the reduced pressure.

6. The method of claim 1, comprising:

drawing the injection fluid into an injection fluid chamber by reducing pressure in the injection fluid chamber; and pressurising the injection fluid in the injection fluid chamber.

7. The method of claim 6, comprising reducing pressure in the injection fluid chamber to a level below hydrostatic pressure outside the injection fluid chamber.

8. The method of claim 6, comprising diverting a portion of the flow of production fluid to pressurise the injection fluid in the injection fluid chamber.

9. The method of claim 8, comprising:

passing production fluid through an open pressurisation control valve when pressurising the injection fluid in the injection fluid chamber; and closing the pressurisation control valve when drawing the injection fluid into the injection fluid chamber.

10. The method of claim 9, comprising controlling the pressurisation control valve to control pressurisation of the injection fluid in the injection fluid chamber.

11. The method of claim 9, comprising introducing the diverted portion of the production fluid into a production fluid chamber to pressurise the injection fluid in the injection fluid chamber.

12. The method of claim 11, comprising:

expanding the production fluid chamber under pressure from the introduced portion of the production fluid; and contracting the injection fluid chamber in response to expansion of the production fluid chamber.

13. The method of claim 11, comprising generating a reduced pressure in the production fluid chamber to reduce pressure in the injection fluid chamber.

14. The method of claim 13, comprising:

contracting the production fluid chamber; and expanding the injection fluid chamber in response to contraction of the production fluid chamber.

15. The method of claim 13, comprising returning production fluid from the production fluid chamber into the flow of production fluid.

16. The method of claim 15, comprising:

passing the returned production fluid through a filling control valve when drawing the injection fluid into the expanding injection fluid chamber; and controlling the filling control valve to control filling of the injection fluid chamber with the injection fluid.

17. The method of claim 11, comprising reciprocating a piston between the production fluid chamber and the injection fluid chamber, that piston having opposed heads that partially define the respective chambers.

18. The method of claim 1, wherein the flow of production fluid is in a subsea production pipeline.

19. The method of claim 18, wherein the pipeline extends from a subsea wellhead.

20. The method of claim 1, further comprising injecting the pressurised injection fluid into the subsea installation or equipment.

21. The method of claim 20, comprising:

passing the pressurised injection fluid through an injection control valve before injection into the subsea installation or equipment; and controlling the injection control valve to control injection of the injection fluid into the subsea installation or equipment.

22. The method of claim 20, comprising passing the pressurised injection fluid through a non-return valve before injection into the subsea installation or equipment.

23. The method of claim 1, comprising separating and removing gas from the production fluid before using the production fluid to pressurise the injection fluid.

24. A system for pressurising an injection fluid for injection into an installation or equipment subsea, the system comprising:

an injection fluid source containing the injection fluid;

a production fluid source containing a hydrocarbon production fluid;

an ejector that is powered by a flow of the production fluid; and a pressure booster that is responsive to the ejector to draw injection fluid from the injection fluid source for pressurisation;

wherein the pressure booster comprises:

an injection fluid inlet connected to the injection fluid source;

a production fluid inlet connected to the production fluid source to receive production fluid under pressure to pressurise the injection fluid to above the pressure of the production fluid;

a production fluid outlet connected to the ejector to exhaust the production fluid; and an injection fluid outlet for the pressurised injection fluid.

25. The system of claim 24, wherein a subsea production pipeline serves as the production fluid source and channels the flow of the production fluid.

26. The system of claim 24, wherein the injection fluid in the injection fluid source is under hydrostatic pressure.

27. The system of claim 24, further comprising a non-return valve in an injection fluid supply line between the injection fluid source and the injection fluid inlet of the pressure booster.

28. The system of claim 25, wherein the pressure booster comprises:

a production fluid chamber communicating with the production fluid inlet for receiving the production fluid from the production fluid source and communicating with the production fluid outlet for exhausting the production fluid, the production fluid chamber being expansible in response to receiving the production fluid; and an injection fluid chamber for pressurising the injection fluid by contracting in response to expansion of the production fluid chamber, the injection fluid chamber communicating with the injection fluid inlet for receiving the injection fluid from the injection fluid source and communicating with the injection fluid outlet for outputting the pressurised injection fluid.

29. The system of claim 28, wherein the pressure booster further comprises a piston between the production fluid chamber and the injection fluid chamber, that piston having opposed piston heads that partially define the respective chambers.

30. The system of claim 29, wherein the piston head of the production fluid chamber has a greater diameter than the piston head of the injection fluid chamber.

31. The system of claim 28, further comprising a production fluid diversion line that connects the pressure booster to the production fluid source.

32. The system of claim 31, further comprising a pressurisation control valve in the production fluid diversion line for controlling expansion of the production fluid chamber and contraction of the injection fluid chamber.

33. The system of claim 31, further comprising a gas separator in the production fluid diversion line.

34. The system of claim 28, further comprising a return line that connects the pressure booster to the ejector, and a filling control valve in the return line for controlling contraction of the production fluid chamber and expansion of the injection fluid chamber.

35. The system of claim 24, further comprising an injection line connected to the injection fluid outlet of the pressure booster, and an injection control valve in the injection line for controlling injection of the injection fluid into the subsea installation or equipment.

36. The system of claim 35, wherein the injection line further comprises a non-return valve between the injection fluid outlet of the pressure booster and an injection point for introducing the injection fluid into the subsea installation or equipment.

* * * * *